US005625901A

United States Patent [19]

Healy

[11] Patent Number: 5,625,901

[45] Date of Patent: May 6, 1997

[54] VENTILATING HAT BAND

[76] Inventor: James W. Healy, 1200 Westwood Dr., #35, Sandpoint, Id. 83864

[21] Appl. No.: 539,129

[22] Filed: Oct. 4, 1995

[51] Int. Cl.[6] ..... A42B 1/00

[52] U.S. Cl. ..... 2/182.2; 2/182.1; 2/182.6

[58] Field of Search ..... 2/414, 418, 420, 2/181, 181.2, 181.4, 181.6, 181.8, 182.1, 182.2, 182.3, 182.5, 182.6, 209.12, 209.4, 195.1

[56] References Cited

U.S. PATENT DOCUMENTS

| | | | |
|---|---|---|---|
| 1,187,507 | 6/1916 | Coyne | 2/181.8 X |
| 1,207,137 | 12/1916 | Clore | 2/181.8 |
| 2,698,434 | 1/1955 | Davia | 2/3 |
| 2,997,792 | 8/1961 | Straus | 2/182.1 X |
| 3,505,683 | 4/1970 | Wright | 2/182.1 X |
| 4,766,614 | 8/1988 | Cantwell et al. | 2/414 |
| 4,951,320 | 8/1990 | Yoon | 2/181.2 |
| 4,972,527 | 11/1990 | Wallace | 2/414 |
| 5,317,761 | 6/1994 | Piche | 2/181.4 X |

*Primary Examiner*—C. D. Crowder
*Assistant Examiner*—Shirra L. Jenkins
*Attorney, Agent, or Firm*—Wells, St. John, Roberts, Gregory & Matkin, P.S.

[57] ABSTRACT

A hat band is described for attachment to or integration with a hat having a hat band area circumscribing a crown. The hat band includes an elongated flexible base including an inside and an outside surface. A plurality of flexible fingers are spaced apart along the base and project from the inside surface thereof to remote ends. Pressure sensitive adhesive or other securement is provided for selectively attaching the outside surface of the elongated flexible base to the hat band area of the hat. The fingers function to hold the hat band area away from the scalp to allow ventilation and to prevent matting or depression of the hair or what is commonly referred to as "hat hair."

15 Claims, 9 Drawing Sheets

VENTILATING HAT BAND

TECHNICAL FIELD

The present invention relates to inside hat bands sometimes referred to as "sweat bands," and more particularly to a hat band that provides ventilation and that will not press and dishevel the hair of the wearer.

BACKGROUND OF THE INVENTION

One reason many people do not wear hats is that the hat band compresses the hair and leaves a formed depression or matting commonly known as "hat hair". Another reason is that hat bands and the hat itself cut off air circulation to the covered area of the head. This often results in uncomfortable heating and resultant perspiration.

A need has therefor existed for a hat or hat band adaptable to existing hats that will avoid "hat hair" and that will provide adequate ventilation to the covered area of the wearer's head.

The present hat band provides a solution to both needs, as will be readily understood from the following specification and drawings.

BRIEF DESCRIPTION OF THE DRAWINGS

Preferred embodiments of the invention are described below with reference to the accompanying drawings, which are briefly described below.

FIG. 7 is a view similar to FIG. 6 only showing an alternate securing means for attaching the base to a hat;

FIG. 9 is a side elevation view of a second embodiment;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
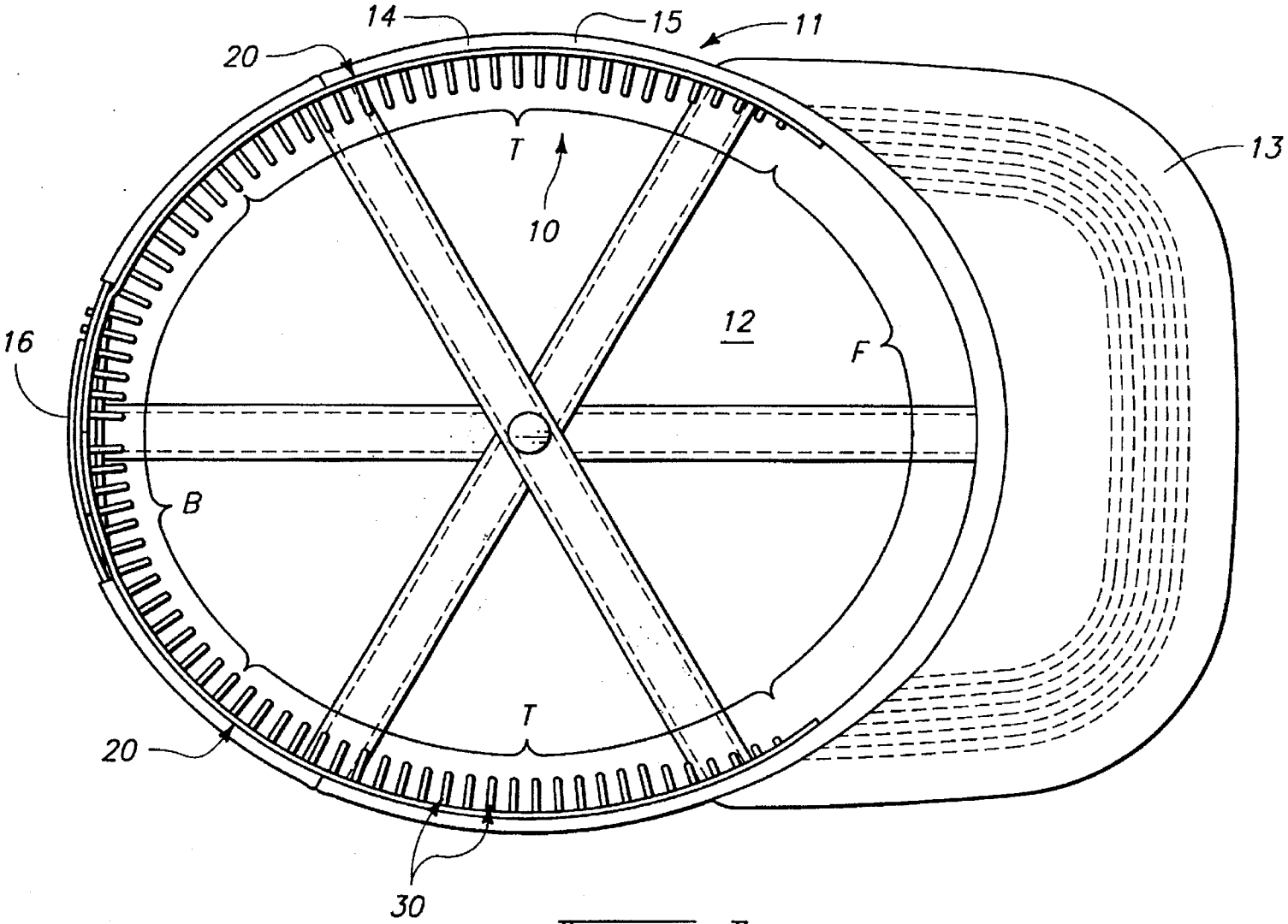
FIG. 1 is a bottom plan view of a hat with the present invention.

The present invention may be embodied in at least three forms. Each form will be discussed separately with like elements referred to by like numerals. In a first embodiment (FIG. 1), the present invention, designated generally by the reference numeral 10 is provided in two segments adapted to be attached to an existing form of conventional hat 11. In a second embodiment (FIG. 9), the invention 10 is provided in a single segment for attachment to an existing hat. In a third embodiment (FIGS. 10, 11), the invention 10 is produced along with a hat 70.

In another form, in which the present hat band is manufactured along with a hat (FIG. 11), the hat band 10 is produced in a continuous loop, with substantially equal length fingers 30 spaced apart along the entire interior perimeter.

The first embodiment of the present invention 10 is provided for selective attachment to an existing hat 11 of any common form, having a crown 12, a brim 13, and a hat band area circumscribing the crown 12. The typical hat 11 will also include a conventional hat band 15. In many hats, the hat band is continuous about the inside surface of the crown. In common adjustable size hat configurations (shown) an adjustable but relatively continuous hat band is provided, separable at the back side of the hat by an adjustment tab arrangement 16. The present invention 10 will function equally well in any of these conventional hat forms.

For purposes of further description, the hat band area is divided into a forehead section F, opposed temple sections T, and a back section B. The forehead section F generally spans the forehead of the wearer, from the hairline on one side of the head to the hairline on the opposite side. The temple sections T span the lateral aspects of the head from the hairlines laterally of the forehead to the lateral aspects of the skull posterior. The back section B would then cover the skull posterior, where curvature of the skull in the transverse plane is most acute.

In a first preferred form, the present invention includes a pair of elongated flexible bases 20, each including an inside and an outside surface 21, 22. The bases are substantially identical, each having a length dimension between forward ends 23 and rearward ends 24. A midsection 27 is between the forward and rearward ends 23, 24. A width dimension is measured between opposed substantially parallel longitudinal edges 25, 26.

The bases 20 are advantageously formed of a flexible injection molded thermoplastic material. Exemplary suitable materials are polypropylene, polyethylene, styrene or polyester plastics. The selected material is preferably scissile to permit cutting for adjustment purposes.

The thickness dimension of the bases, between inside and outside surfaces 21, 22 may vary somewhat with the nature of the material but is not substantially thicker than approximately 5 mm. A thickness of approximately 2 mm has been found to provide sufficient material to adequately support and flexibly hold the fingers 30 (described below) in desired orientations.

The bases may be sold in various lengths, between forward and rearward ends 23, 24 or each base 20 may be varied in length according to hat size. In a preferred form the selected or adjusted length of each base 20 be approximately ⅓ the circumference of the hat band area of the largest hat size, or approximately 22 cm. The finished length of each base 20 (when mounted to a hat and placed on the wearer's head) will advantageously extend from the temple hairline laterally of the forehead, across the adjacent lateral aspect, and terminate approximately on the mid-sagittal plane along the posterior aspect of the skull.

The width dimension (between side edges 25, 26) may also vary according to need, but will not be narrower than approximately 16 mm and no wider than approximately 4 cm. This dimension is selected to substantially match existing hat band width dimensions.

A plurality of flexible fingers 30 are spaced apart and project from the inside surface 21 of each elongated flexible base 20. In a preferred form, the fingers are integral with the elongated flexible bases 20 and are formed with the bases by common procedures such as injection molding or casting.

Figure 2:
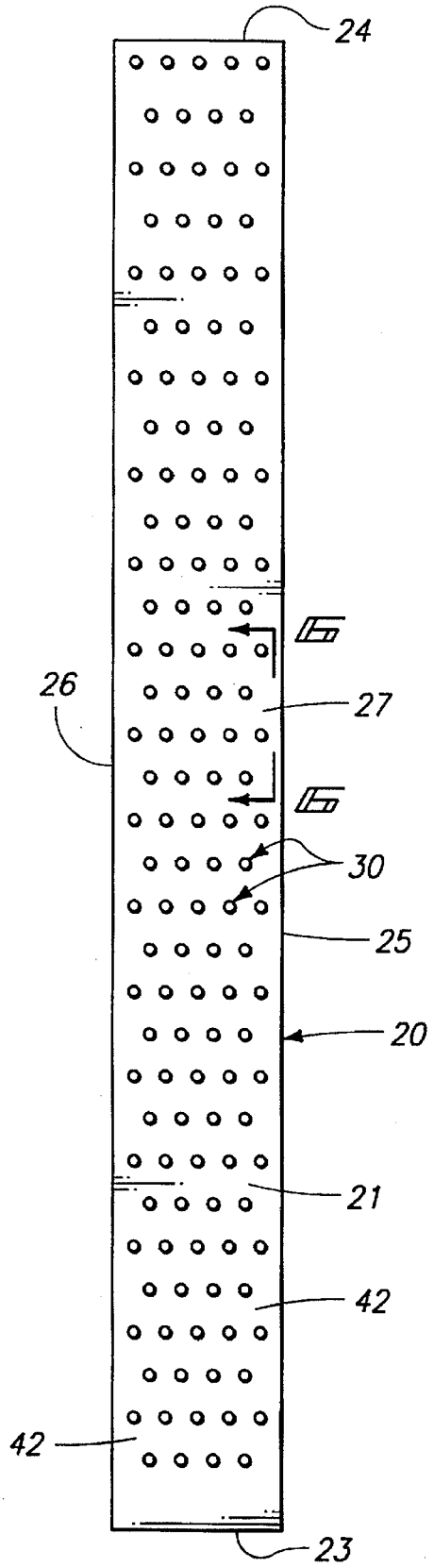
FIG. 2 is a plan view of a single elongated flexible base and fingers in a first preferred form.
Figure 3:
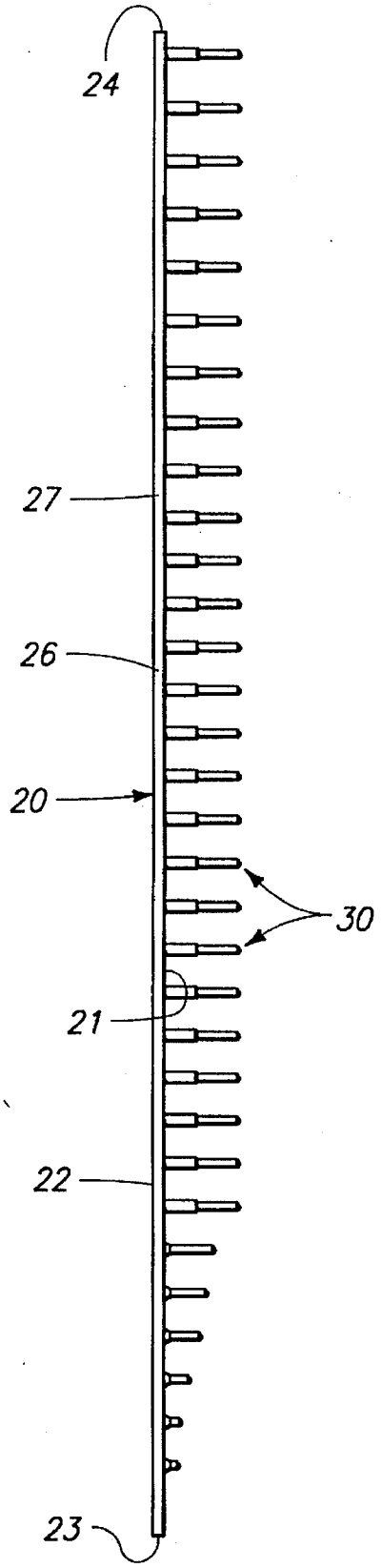
FIG. 3 is a side elevation view thereof.

The fingers 30 are provided in longitudinally and transversely spaced relation along the bases 20. In one preferred arrangement, the fingers are provided in staggered rows as shown in FIG. 2. Other arrangements for the fingers are also possible, but spacing between adjacent fingers should be within a range of between approximately 3 and 13 mm. The preferred spacing between adjacent fingers 30 is approximately 6 mm.

It is also preferred that spacing between adjacent fingers 30 near the rearward ends 24 of the bases 20 be somewhat greater than spacing of the fingers adjacent the forward ends 23. This is done to eliminate the possibility that the fingers at the rearward base ends 24 will cross when the base is bent to conform to the posterior aspect of the user's head.

Figure 4:
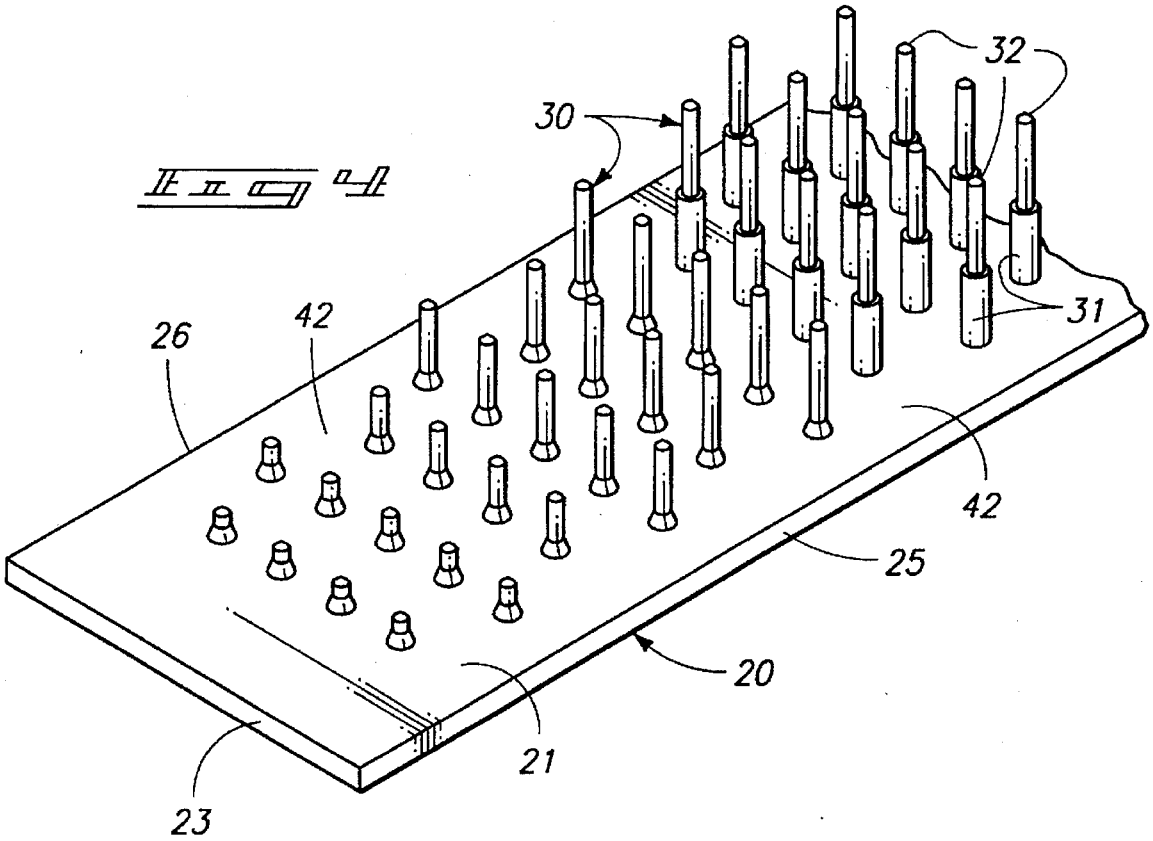
FIG. 4 is a fragmented perspective view of a forward end of a base and adjacent fingers.
Figure 6:
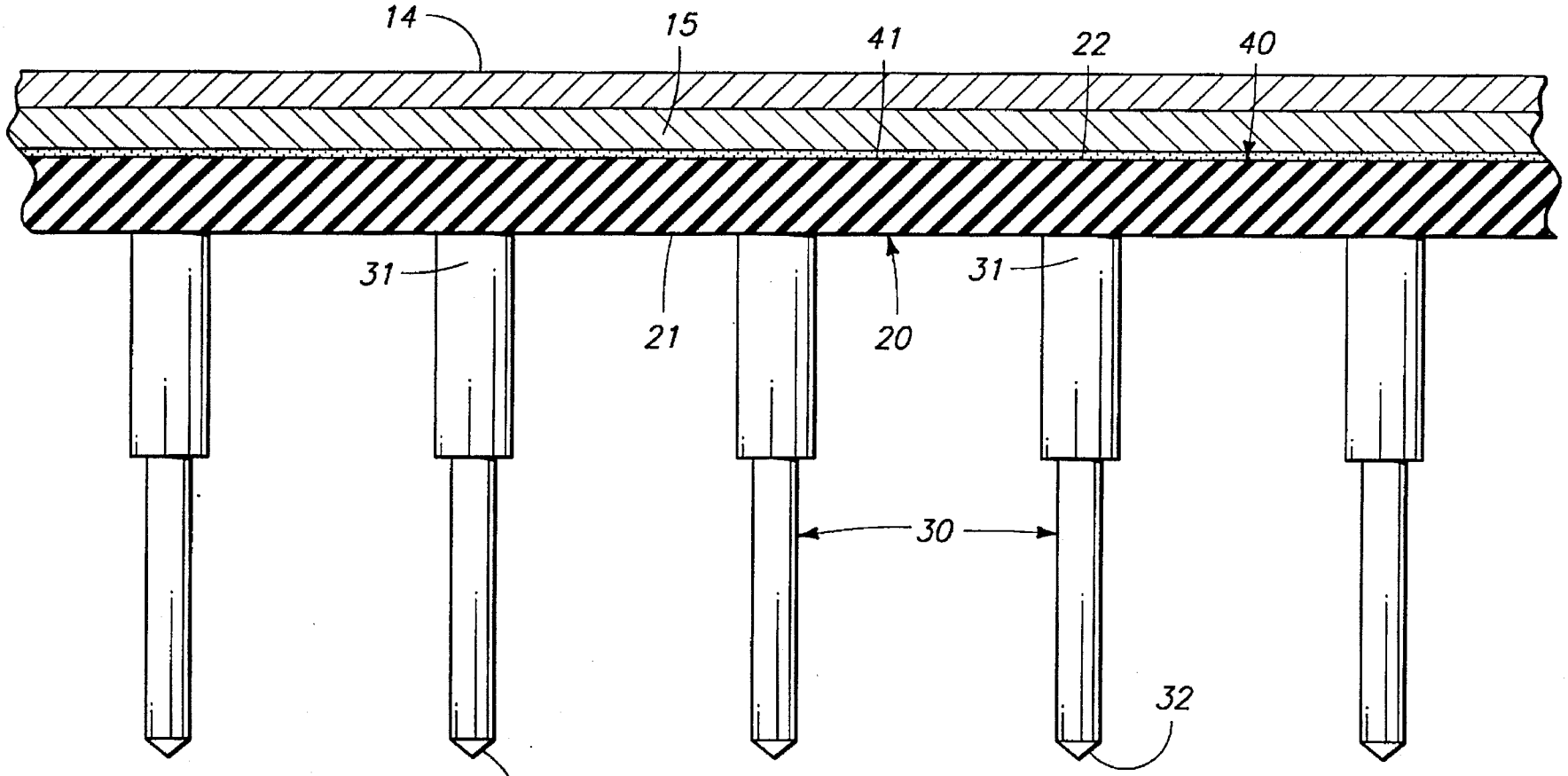
FIG. 6 is an enlarged fragmented sectional view taken substantially along line 6—6 in FIG. 2.

Each one of the plurality of flexible fingers includes a root end 31 (FIG. 4) at the inside surface 21 of the associate base 20, and a remote end 32. In a preferred form, the root ends and remote ends of the fingers are oriented along axes that are substantially perpendicular or normal to the inside surface 21 when the bases 20 are laid flat (FIGS. 6, 7). The fingers will become substantially radially oriented (FIGS. 1, 10) when the bases 20 are mounted to a hat 11.

The plurality of flexible fingers 30 include length dimensions between the root ends 31 and the remote ends 32. Preferably, the lengths of the flexible fingers situated adjacent the forward end 23 of the associated elongated flexible base 20 are shorter than the length dimensions of the flexible fingers situated at the mid-section 27, or those adjacent the rearward end 24 of the elongated flexible base. Such diminishing finger lengths accommodates a gradual transition to the new circumference of the new hat band as it changes from the existing hat band area.

In one preferred form, the finger length is between approximately 6 mm and 16 mm from the root ends to the remote ends and preferably approximately 10 mm. Fingers with such spacing and length dimensions have the ability to space the hat band away from the scalp, without depressing the hair and creating the undesirable "hat hair" appearance. Still further, it has been found that flexible fingers at the preferred length and spacing is desirable to permit ventilation between the fingers.

It is also preferable that the fingers taper along their lengths. Such taper may be in a stepped arrangement as shown, or a smooth taper from the larger root ends to the reduced remote ends. The taper allows for greater flexibility in the fingers toward the remote ends 32 and maximizes the ventilation area between fingers.

Figure 5:
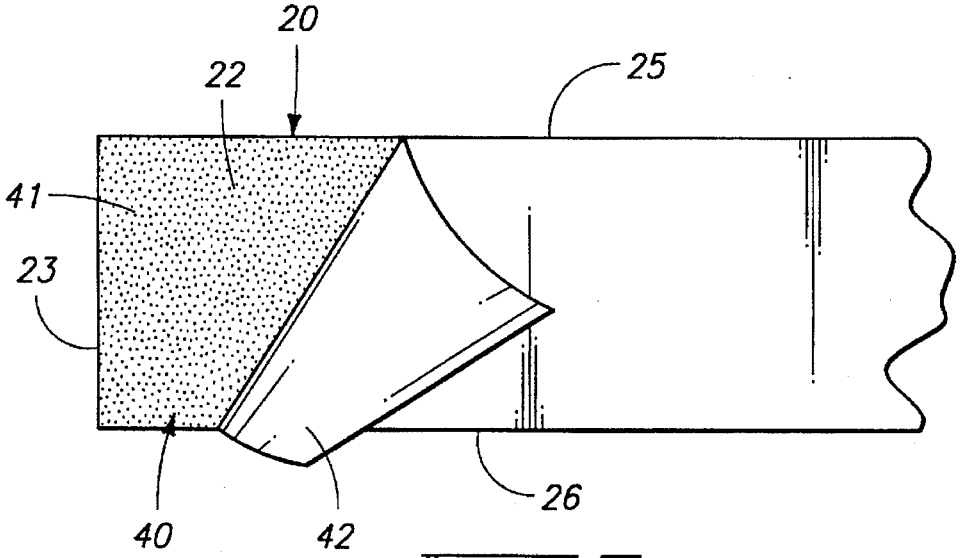
FIG. 5 is a fragmented elevation view of the outward side of the base part, showing an adhesive layer and partially removed backing strip.

Securing means 40 is provided for selectively attaching the outside surfaces 22 of the elongated flexible bases 20 to the hat band area 15 of the hat. In one preferred form, the securing means includes a pressure sensitive adhesive 41 (FIGS. 5, 6) covered by a removable backing strip 42. The adhesive 41 is selected to substantially permanently secure the bases 20 to the hat band area or hat band 15 of the hat 11. In another form, the securing means 40 includes at least one, and preferably two marginal side surfaces along one or both of the longitudinal side edges 25. The marginal side surfaces are adapted to be sewn to the hat as shown at 43 in FIG. 7. Still other arrangements of the securing means might also be utilized, such as hook and loop fasteners, applied adhesives, snaps, buttons, zippers, clips, (not shown) or equivalents thereof.

In the second embodiment (FIG. 9), the same or equivalent elements as described above are provided with the exception that a single base 50 is provided. This base 50 includes a length dimension that is approximately equal to twice that of the individual bases 20. More particularly, the base 40 is advantageously provided in a variety of selective length dimensions according to various hat sizes. Alternatively, the single base may be cut to size by removing a selected length of the base and associated fingers, at an approximate mid point along the base length. This leaves two base sections similar to those described above for attachment to the hat.

The elongated flexible base 50 of the second embodiment extends to opposed ends 51, at which the adjacent fingers 30 diminish in length as shown in FIG. 9. Spacing and lengths of the fingers 30 on this embodiment are similar to those for the first embodiment described above.

Figure 11:
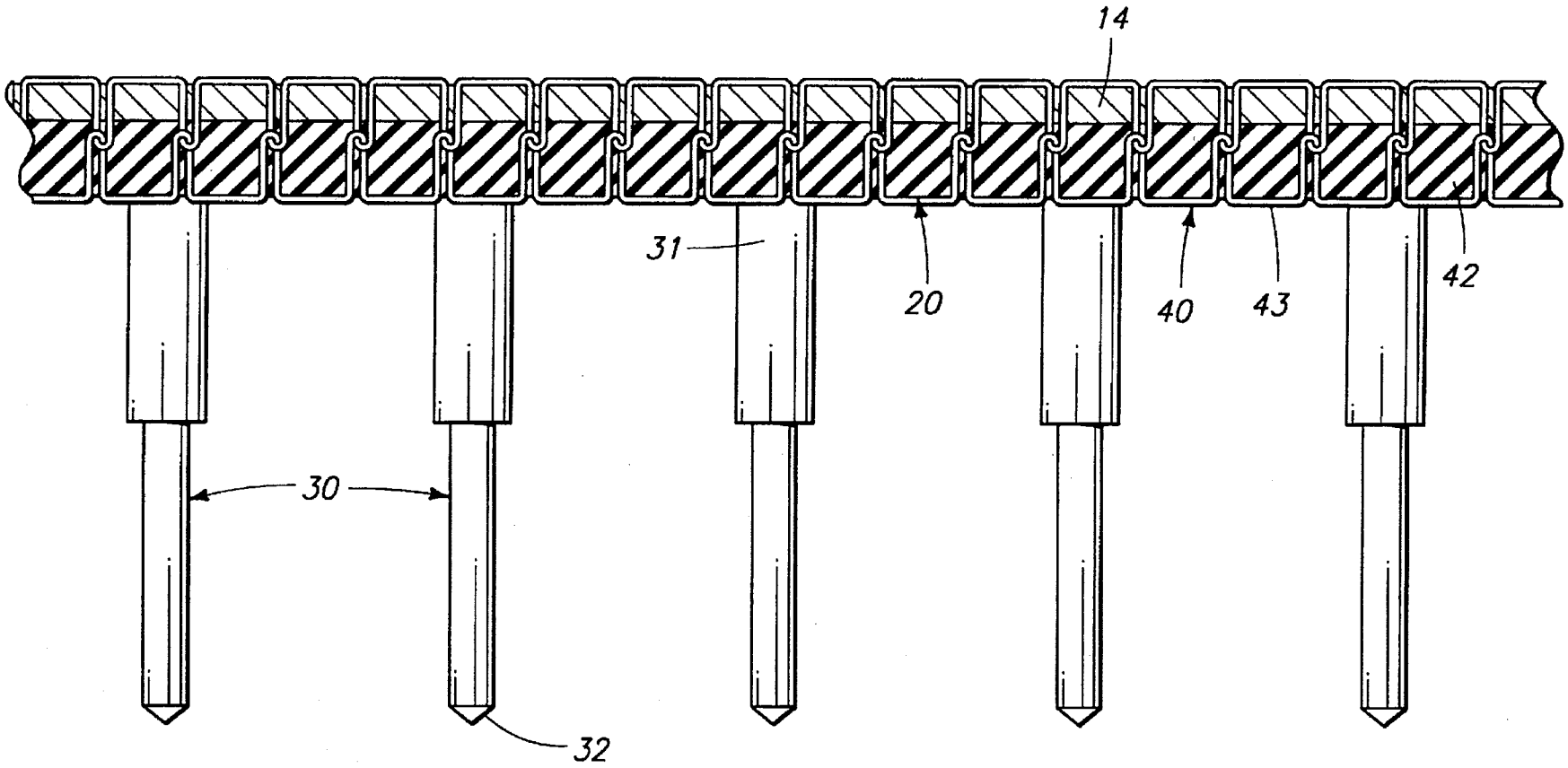
FIG. 11 is a view of the third embodiment with fingers spaced about the entire hat band interior perimeter.
Figure 10:
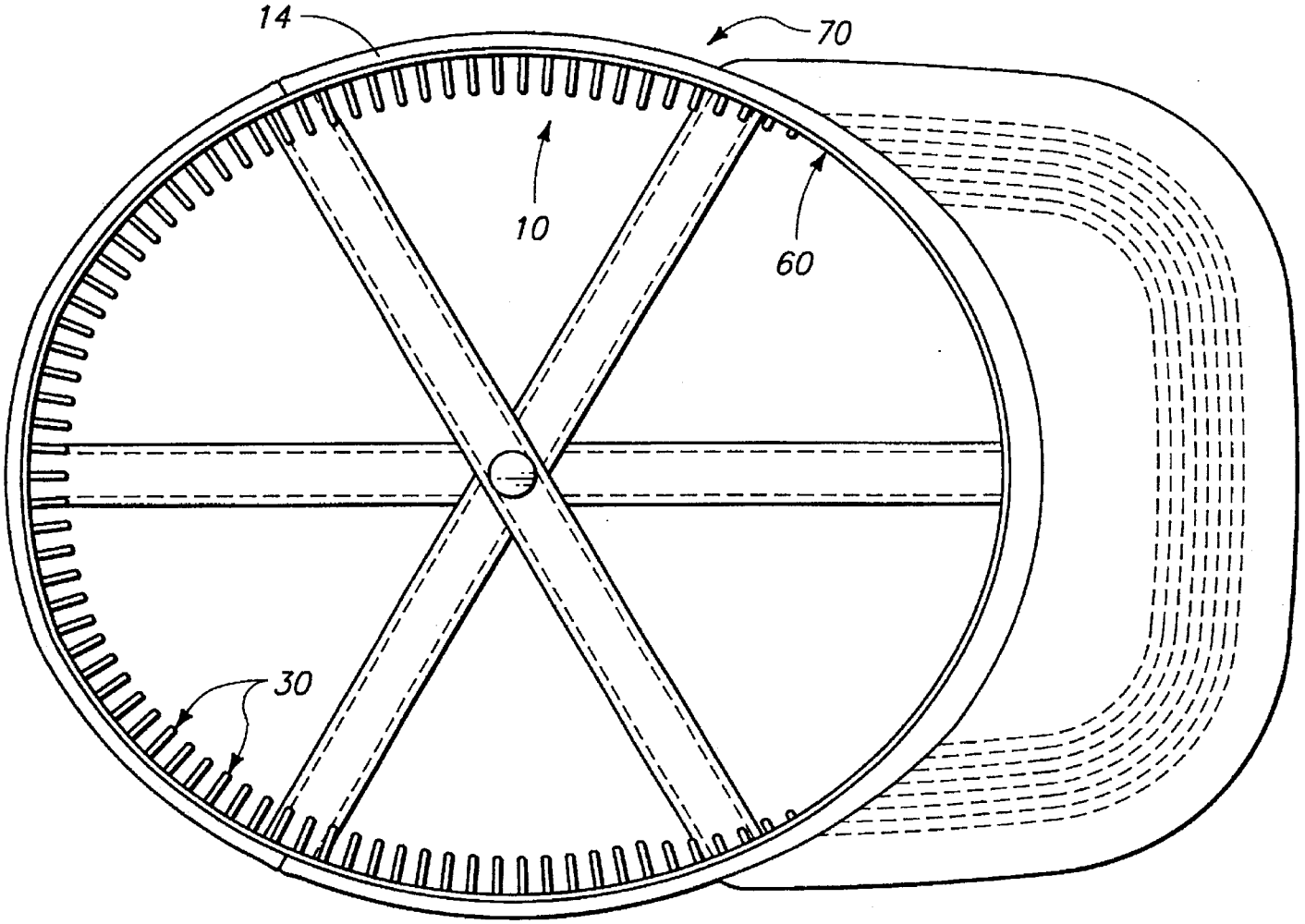
FIG. 10 is a view of a third embodiment in which a hat and present ventilated band are combined.
Figure 11:
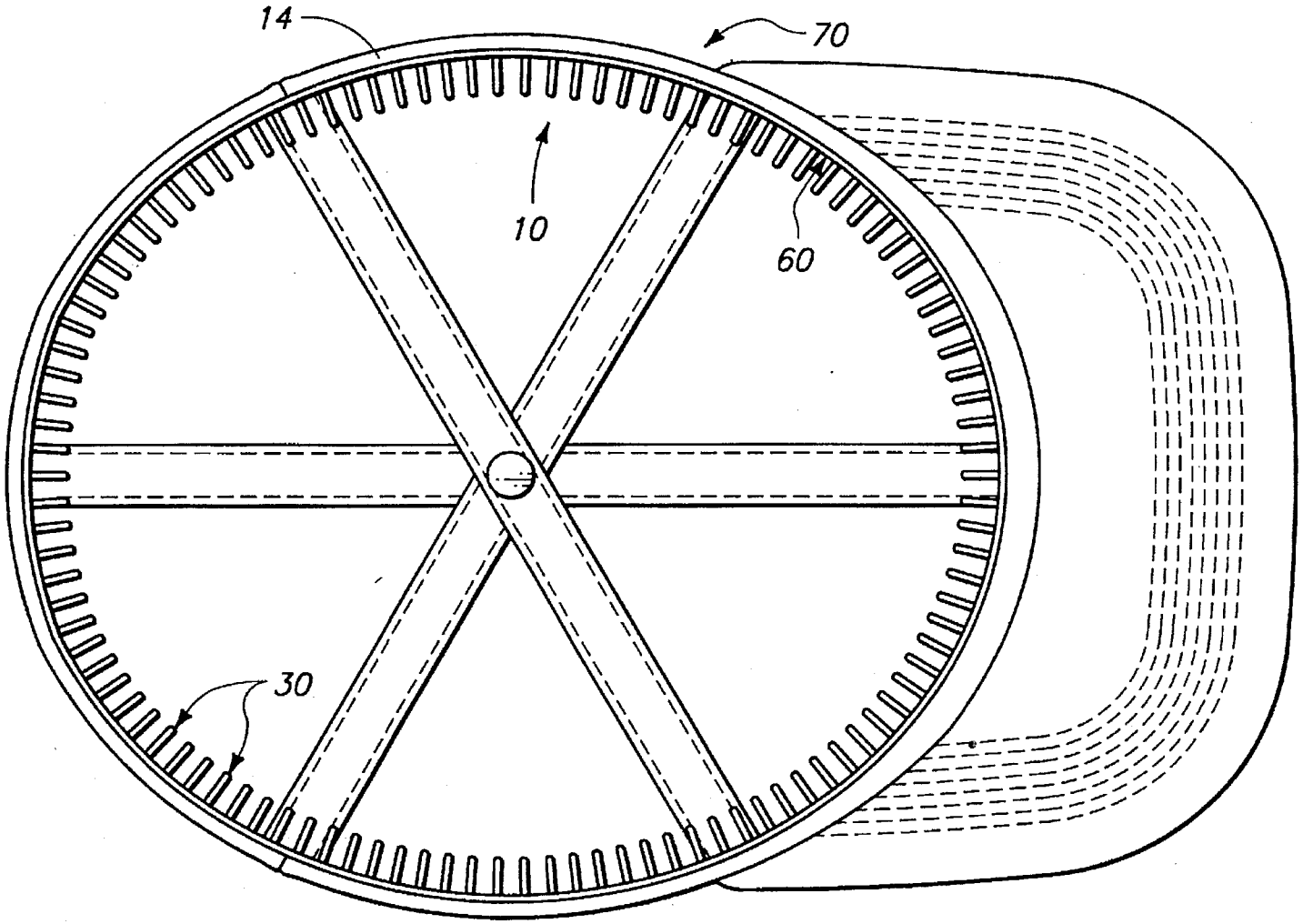

In the third embodiment, the flexible base 60 may be formed as for the second embodiment, or may be provided as a circumferential loop as shown in FIGS. 10 and 11, within the hat band area to function as a hat band, integral with the hat 70. Thus it may be seen that the present invention may be provided as an integral part of a hat 70, that is assembled with the hat by the manufacturer. In this embodiment other elements including the finger configuration, spacing and lengths are advantageously equivalent or identical to those described above. Further, as discussed above, the fingers 30 may be provided about the entire inside circumference of the band as shown in FIG. 11.

Figure 8:
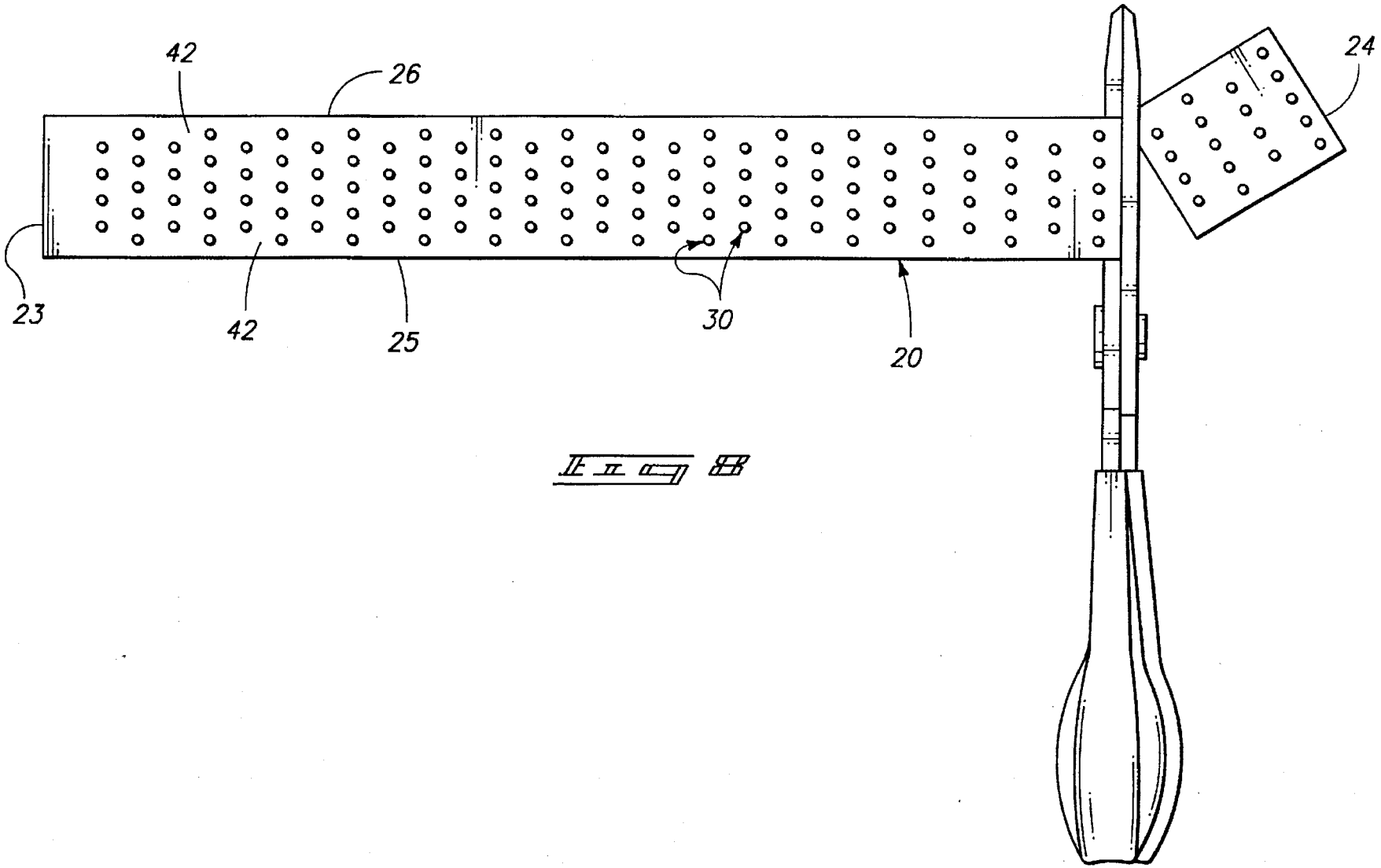
FIG. 8 is a view showing the base being cut near its rearward end for adjustment to fit a particular hat size.
Figure 11:
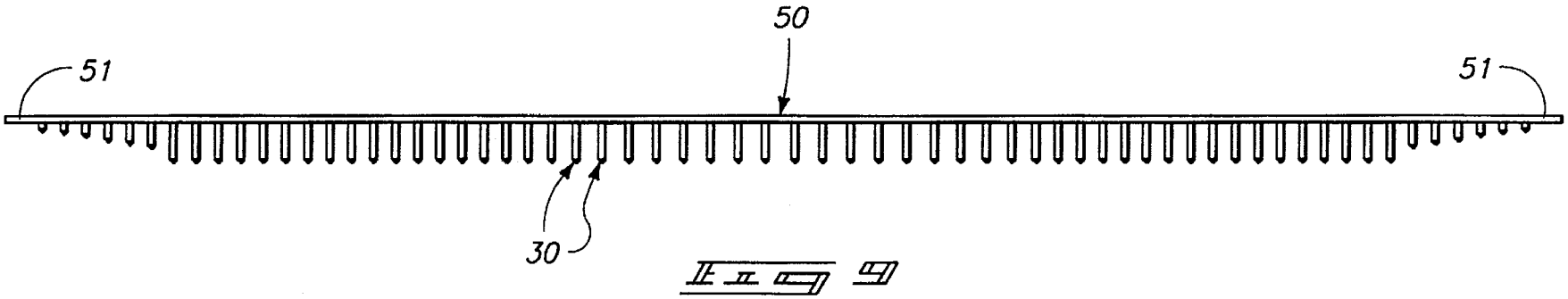

Installing either of the first two embodiments is a relatively simple matter of selecting a hat and attaching the bases 20 or base 50 to the inside surface of the hat band area. It is preferable that a hat be selected of a size approximately 10 mm to 13 mm increased diameter than the hat size normally worn. This allows for placement of the bases 20, or base 50. Next, the user places the hat on the head and marks the location of the hairline at the temples on the hat band. The hat is then removed and the bases are positioned in the hat with the forward ends 23 at the hairline marks. If the rearward ends overlap, scissors or other appropriate cutting tool is used to cut away the overlapping sections (FIG. 8). The bases are now ready to install. Installation is completed in the form shown by simply removing the backing strips 42 and pressing the bases 20 in place against the existing hat band with the cut ends in abutment at the back center of the hat. If other types of securing means are used, fastening will be accomplished according to the particular form of securing means being used. The hat is now ready to wear.

Installation of the second embodiment is similar to that described above with the exception that if the bases 50 are provided according to hat size and temple hairline location, no trimming may be required. If trimming is required, a selected section of the base is cut away, again by scissors or other appropriate cutting instrument. Attachment to the hat then follows the steps described above.

In the third form, installation has been previously accomplished by the manufacturer, so the user has only to select the proper hat size and place the hat on his or her head.

In operation, as the hat is placed on the head, the inwardly projecting fingers serve to space the hat band area away from the scalp in such a manner that the hat band and base or bases 50, 20 will not compress the adjacent hair. The spaced fingers also permit ventilation to the area between the skull and hat crown, especially in the area of the hat band. The user is thus able to wear the hat without fear of the hat band depressing the hair or the scalp perspiring in the area of the hat band. The fingers also have a tendency to hold the hat in place on the user's head. This is a distinct advantage in windy conditions or when the user is involved in vigorous physical activity.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A hat band for attachment to a hat having a hat band area circumscribing a crown, comprising:

an elongated flexible base including an inside and an outside surface;

a plurality of flexible fingers spaced apart and projecting from the inside surface of the elongated flexible base;

securing means for selectively attaching the outside surface of the elongated flexible base to the hat band area of the hat;

wherein the elongated flexible base includes a forward and a rearward end, with the flexible fingers being spaced apart along the elongated flexible base from adjacent the forward end to the rearward end;

wherein the plurality of flexible fingers include root ends attached to the elongated flexible base and remote ends;

wherein the plurality of flexible fingers include length dimensions between the root ends and the remote ends; and wherein the length dimensions of the flexible fingers situated adjacent the forward end of the elongated flexible base are shorter than the length dimensions of the flexible fingers situated adjacent the rearward end of the elongated flexible base.

2. A hat band as claimed by claim 1, wherein the elongated flexible base includes a forward and a rearward end, and a mid section between the forward and rearward ends;

wherein the flexible fingers are spaced apart longitudinally along the elongated flexible base from adjacent the forward end to the rearward end; and wherein the flexible fingers adjacent the rearward end of the elongated flexible base are spaced apart further along the elongated flexible base than the elongated flexible fingers adjacent the mid section of the elongated flexible base.

3. A hat band as claimed by claim 1, wherein the flexible fingers are integral with the elongated flexible base.

4. A hat band as claimed by claim 1, wherein the flexible fingers are spaced apart longitudinally along the inward surface of the elongated flexible base and transversely across the inward surface of the elongated flexible base.

5. A hat band as claimed by claim 1, wherein the flexible fingers include root ends attached to the elongated flexible base and remote ends, and wherein the fingers are tapered, diminishing in cross sectional size from the root ends to the remote ends.

6. A hat band as claimed by claim 1, wherein the elongated flexible base includes opposed longitudinal side edges and wherein the securing means includes at least one marginal side surface along one of the longitudinal side edges adapted to be sewn to a hat.

7. A hat band as claimed by claim 1, wherein the securing means includes a pressure sensitive adhesive on the outward surface of the elongated flexible base.

8. A hat band as claimed by claim 1, wherein the elongated flexible base includes a forward and a rearward end and wherein the elongated flexible base is scissile adjacent the rearward end thereof.

9. A hat band as claimed by claim 1, wherein the elongated flexible base includes opposed longitudinal end sections and an intermediate longitudinal section;

wherein the fingers are spaced apart longitudinally along the elongated flexible base and include root ends attached to the elongated flexible base, and remote ends;

wherein the fingers include length dimensions between the root ends and remote ends; and wherein the length dimensions of the fingers adjacent the opposed end sections of the elongated flexible base are of diminished length dimension with respect to the finger lengths along the intermediate longitudinal section.

10. A hat band as claimed by claim 1, wherein the elongated flexible base includes opposed longitudinal end sections and an intermediate longitudinal section;

wherein the fingers are spaced apart longitudinally along the elongated flexible base; and wherein the fingers along the intermediate longitudinal section are spaced apart longitudinally further than the longitudinal spacing of the fingers along the opposed longitudinal end sections.

11. A hat band as claimed by claim 1, wherein the fingers are spaced apart from one another by a distance of between approximately 3 mm and 13 mm.

12. A hat, comprising:

a crown having a circumferential hat band area;

a hat band including an elongated flexible base with an inside and an outside surface;

a plurality of flexible fingers spaced apart and projecting from the inside surface of the elongated flexible base; and securing means attaching the elongated flexible base to the crown along the hat band area;

wherein the hat band area includes a forward forehead section, intermediate opposed temple sections, and a rearward section;

wherein the hat band extends from the temple sections to the rearward section of the hat band, and includes forward ends adjacent the forward forehead section;

wherein each of the flexible fingers includes a base end and a remote end with a length dimension between the base end and remote end;

wherein the length dimensions of the flexible fingers adjacent the forward ends of the hat band are diminished with respect to the flexible fingers along the temple sections.

13. A hat as claimed by claim 12, wherein the length dimensions of the flexible fingers along the temple sections are diminished with respect to the flexible fingers along the rearward sections.

14. A hat as claimed by claim 12, wherein the hat band area includes a forward forehead section, intermediate opposed temple sections, and a rearward section;

wherein the flexible fingers are spaced apart longitudinally along the hat band, with longitudinal spacing between successive flexible fingers along the rearward section of the hat band area being greater than longitudinal spacing between successive flexible fingers along the temple sections of the hat band area.

15. A hat as claimed by claim 12, wherein the fingers are spaced apart from one another by a distance of between approximately 3 mm and 13 mm.

* * * * *